United States Patent [19]

Adams

[11] Patent Number: 4,864,667

[45] Date of Patent: Sep. 12, 1989

[54] DISPOSABLE NECK PAD FOR WASH BASINS AND THE LIKE

[76] Inventor: Janet Adams, 662 S. 900 East, Orem, Utah 84058

[21] Appl. No.: 143,720

[22] Filed: Jan. 14, 1988

[51] Int. Cl.[4] ..... A45D 19/00

[52] U.S. Cl. ..... 4/519; 4/523

[58] Field of Search ..... 4/519–523, 4/621, 622, 654, 655, 657, 658

[56] References Cited

U.S. PATENT DOCUMENTS

| | | | |
|---|---|---|---|
| 2,297,639 | 9/1942 | Thauwald | 4/520 |
| 4,411,032 | 10/1983 | Lewy | 4/523 |
| 4,669,132 | 6/1987 | Courson | 4/519 X |

*Primary Examiner*—Charles E. Phillips

*Attorney, Agent, or Firm*—Thorpe, North & Western

[57] ABSTRACT

A neck cushion for use on the upper edge of a conventional, commercial hair wash basin includes an elongate body of material having a central portion and two end portions on either side thereof, with the central portion being formed to be thicker than the end portions. Also, the end portions are formed to be wider than the central portion to enable wrapping the end portions about the upper edge of the wash basin. The cushion also includes adhesive strips of material located on the underneath side for contacting and adhering to the upper edge of a wash basin on which the cushion is placed.

5 Claims, 2 Drawing Sheets

DISPOSABLE NECK PAD FOR WASH BASINS AND THE LIKE

BACKGROUND OF THE INVENTION

This invention relates to a disposable neck cushion for use on the side of a wash basin and on which a person may rest his/her neck while the person's hair is being shampooed.

It is common practice to first shampoo a person's hair before either giving the person a permanent or cutting the person's hair. This is done with specially designed wash basins or sinks having a U-shaped dip or cut-out on the upper edge of one side of the basin for receiving and cradling a person's neck. With the person's neck resting on the dip, the head is positioned over the basin so that the hair can be shampooed and rinsed.

Since wash basins are constructed of ceramic, metal, porcelain or similarly hard material, resting the neck directly on the side of the wash basin can be uncomfortable, even using the dip which is shaped to accommodate a person's neck. Also, after shampooing and rinsing in such a wash basin, and sitting up in an erect position, water which has splashed onto the neck during shampooing may run down the person's back, One prior art approach which attempts to alleviate the discomfort of using the above-noted wash basin involved employment of a cushion shaped very much like a bicycle cross-bar cushion. That is, the cushion is formed of an elongate piece of sponge having a slit or channel which extends the full length of the sponge to allow fitting over the upper edge of a wash basin. With this approach, however, the cushion, because of its cost, would have to be reused and thus would generally be unsanitary. Also, because the cushion is made entirely of sponge, when compressed, water would be squeezed from it, possibly onto the neck of the person using it. Further, the cushion has been found not to be comfortable—generally being too rigid. Finally, the cushion, after use, tends to lose its shape and will not stay seated over the edge of a wash basin.

SUMMARY OF THE INVENTION

It is an object of the invention to provide a comfortable water absorbent neck rest for use on the upper edge of a wash basin in the cut-out section for cushioning the neck of a person.

It is also an object of the invention to provide such a neck rest which retains water absorbed thereby.

It is a further object of the invention to provide such a neck rest which may be readily attached to and detached from the upper edge of a wash basin.

It is a further object of the invention to provide such a neck rest which is simple and economical to construct and therefore is disposable.

The above and other objects of the invention are realized in a specific illustrative embodiment of a disposable neck cushion for use with a wash basin having side walls, at least one of which includes a generally U-shaped cut-out or dip on the upper edge thereof. The neck cushion includes a liquid absorbent, generally elongate body of material having a central portion and two end portions on each side thereof, with the central portion being thicker than the end portions. Also, the central portion is compressible and resilient for cushioning a person's neck when the cushion is placed on the upper edge of the wash basin with the central portion positioned in the cut-out section thereof. The cushion also includes adhesive strips located on the bottom or underneath side of the body for removably attaching the body to the upper edge of the wash basin.

In accordance with one aspect of the invention, the end portions of the body of material are formed to be wider than the central portion so that they may be "wrapped" partly around the upper edge of a wash basin to more securely attach the body to the wash basin. In accordance with another aspect of the invention, the central portion of the body of material bulges both upwardly and downwardly so that the downward bulge generally fits and fills out the cut-out of the wash basin.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
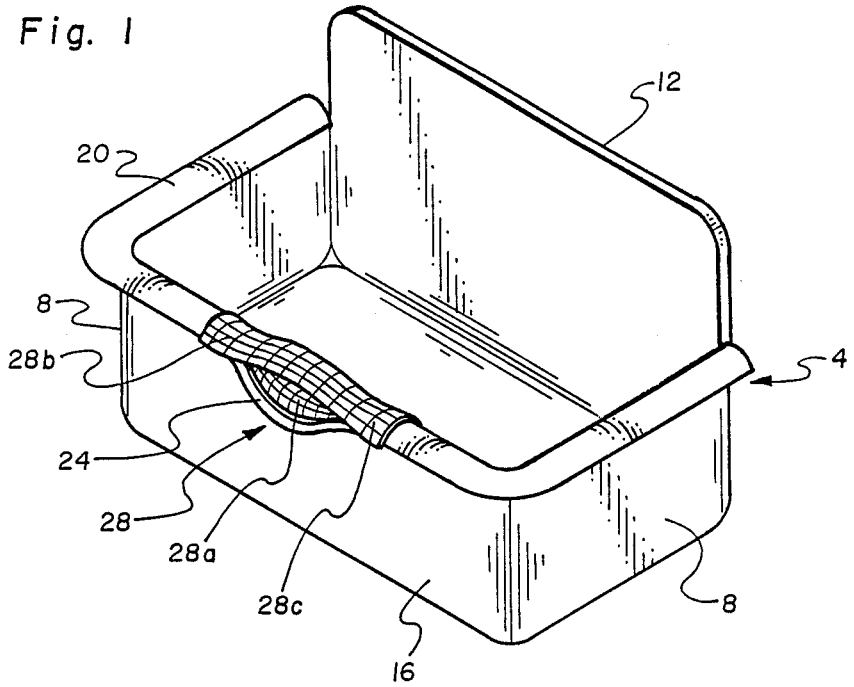
FIG. 1 is a perspective view of a wash basin having installed thereon a neck cushion made in accordance with the principles of the present invention.

Referring to FIG. 1, there is shown a conventional wash basin 4 (without faucets) used for washing or shampooing hair in beauty salons and other commercial beauty care establishments. Such basins include the standard side walls 8, rear wall 12 and front wall 16, with the side walls and front wall including a rolled lip 20 formed on the upper edges thereof as shown. Formed in the lip 20 of the upper edge of the front wall 16 is a U-shaped dip or cut-out 24 dimensioned generally for receiving and cradling the neck of a person whose hair is to be shampooed. The person would be seated in a tilt back chair with his/her neck resting in the cut-out 24 and head positioned generally over the basin 4.

Figure 3:
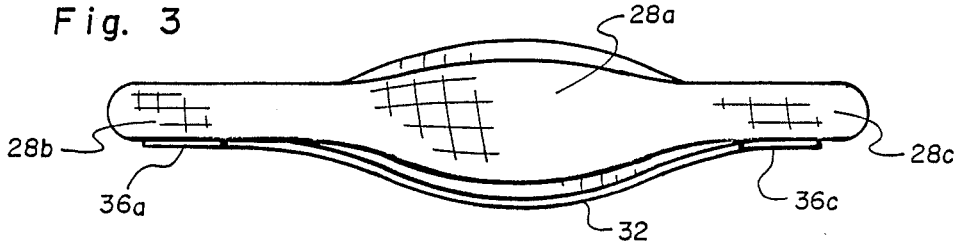
FIG. 3 is a side, elevational view of the neck cushion of FIG. 1, also unattached.

Attached to the lip 20 to substantially fill the dip 24 and extend a distance along the top of the lip 20 on either side of the dip is a neck cushion 28. The cushion includes a central section **28*a* and two end sections 28*b* and 28*c*. The central section 28*a* is thicker than the end sections 28*b* and 28*c*, with the central section formed to bulge both upwardly and downwardly as best seen in FIG. 3. The neck cushion 28 is dimensioned so that the downward bulge of the central section 28*a* substantially fits in and fills the cut-out 24** of a conventional wash basin.

Figure 2:
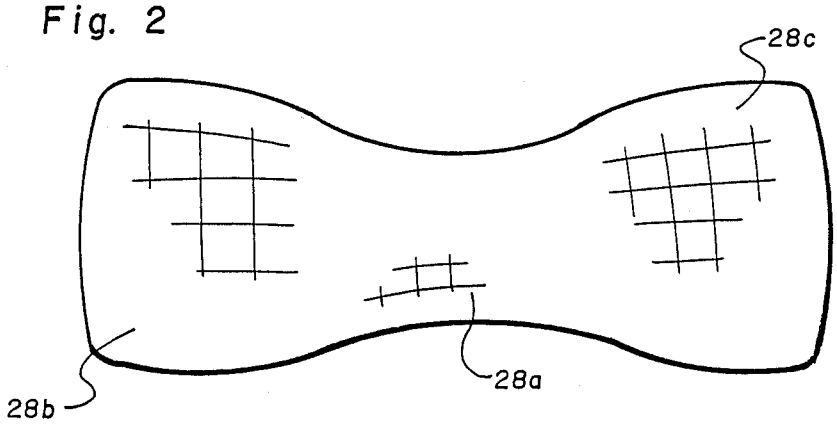
FIG. 2 is a top plan view of the neck cushion of FIG. 1, unattached to any wash basin.
Figure 4:
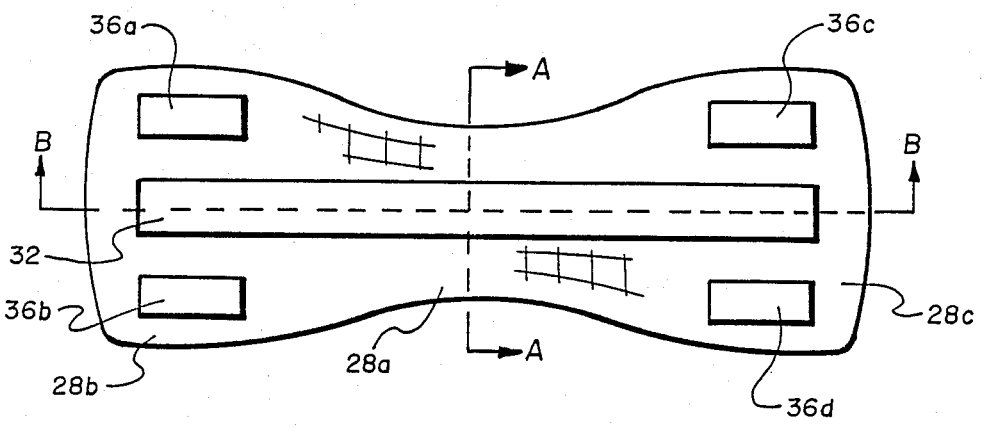
FIG. 4 is a bottom view of the neck cushion of the present invention.

The end sections **28*b* and 28*c* are wider than the central section 28*a*, as best seen in FIGS. 2 and 4, and this enables "wrapping" the end sections about the lip 20 to better secure the cushion on the lip and in the dip 24. The central section 28*a* would have a width about equal to the width of the lip 20 and the end sections 28*b* and 28*c* would have a width which would enable wrapping the sections down the sides of the lip 20**. For example, for a central section width of about four inches, the end sections would advantageously have a width of about five to six inches. The length would advantageously be about eight to twelve inches.

The cushion also includes adhesive strips located on the underneath side thereof for attaching the cushion to the lip 20 of the wash basin. A primary strip 32 (FIG. 4) is located along a midline of the cushion and extends substantially the length thereof. Four smaller strips 36 are each located in a different corner of the cushion, on each side of the central strip 32 on both end sections **28*b* and 28*c*. The adhesive strips 32 and 36 are conventional strips having pull off covers to reveal an adhesive surface which would then allow attaching the cushion to the lip 20 of the wash basin. Positioning the adhesive strips 36*a*, 36*b*, 36*c* and 36*d* on the end sections and on either side of the central strip 32 accommodates wrapping the end sections securely about the lip 20 to hold the cushion in place in the cut-out 24**.

Figure 5A:
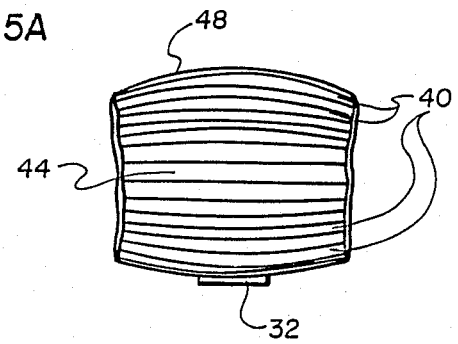
FIG. 5A is a cross-sectional view of the neck cushion of FIG. 4 taken along lines A—A.
Figure 5B:
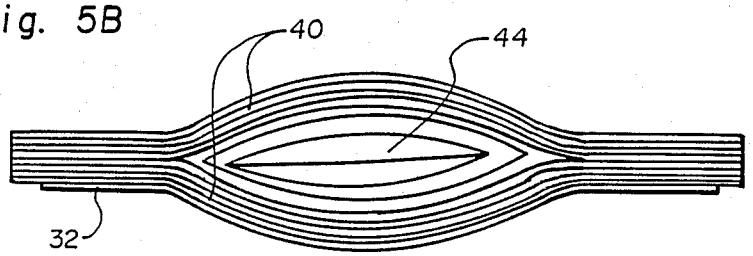
FIG. 5B is a cross-sectional view of the neck cushion of FIG. 4 taken along lines B—B.

The cushion is constructed of a plurality of layers of liquid absorbent, resilient material 40 (FIG. 5) which extends the full length of the cushion. Exemplary materials which could be utilized include cotton fabric, loosely woven muslin, or synthetic fabric. Located only in the central section 28A is a section of liquid absorbent, flexible and resilient material 44. The material 44 could include a section of foam plastic, cellulosic sponge, crepe cellulosic wadding, or other suitable foam material, or additional layers of liquid absorbent material of the same type used for layers 40. To further enhance the liquid absorbing capabilities of the cushion, a water absorbing gel could be dispersed among the layers of the material.

The layers of material forming the cushion are held together at their edges by any suitable adhesive such as glue or by other adhesive attachment mechanism, and could be further secured together by a cover layer 48 which substantially encloses the other layers. The cover layer 48 advantageously is made of a material which allows liquid to be absorbed, but does not readily allow it to pass in the other direction.

In the manner described, a disposable, comfortable liquid absorbing cushion is provided for use with conventional hair wash basins. The cushion includes simple to use adhesive strips for securely attaching the cushion to the upper lip of a wash basin and for readily removing the cushion after use.

It is to be understood that the above-described arrangements are only illustrative of the application of the principles of the present invention. Numerous modifications and alternative arrangements may be devised by those skilled in the art without departing form the spirit and scope of the present invention and the appended claims are intended to cover such modifications and arrangements.

What is claimed is:

1. A disposable neck cushion for use with a wash basin having standard side walls, a rear wall, a front wall with the side walls and front wall including a rolled lip formed on the upper edges thereof and having a generally U-shaped cutout formed on the upper edge thereof, said neck cushion comprising a liquid absorbent, generally elongate body of material having a longitudinal plane passing through a central portion and an end portion on both sides of said central portion, said central portion being thicker than said end portions and bulging both upwardly and downwardly with respect to said plane, with the downward bugle generally dimensioned to fit in and fill the cutout portion of the wash basin, said central portion being generally compressible and resilient for cushioning a person's neck, and said end portions being wider than said central portion in a direction transverse to but included in said plane such that with said cushion in place in said cutout said end portions can wrap about said lip, said end portions having attaching means on their downwardly facing side serving to secure said cushion to said lip.

2. The disposable neck cushion of claims 1 further wherein said attaching means, located on the bottom of said body, comprising a primary adhesive strip and two pair of secondary adhesive strips, said primary adhesive strip extending substantially the length of said body along a midline thereof, and said pairs of secondary adhesive strips being positioned on the bottom of said end portions such that one pair is located on each end portion and each adhesive strip in each pair of strips being located on opposite sides of said primary adhesive strip, whereby, said primary adhesive strip can contact and adhere to the upper edge of the wash basin's U-shaped cutout and the secondary strips can contact and adhere to the inside and outside edges of the U-shaped cutout such that the end portions of the cushion can completely cover the U-shaped cutout in a wraparound manner.

3. The disposable neck cushion of claim 1, said body of material having a cover which allows fluid to flow into said body but prevents fluid from flowing out of said body, and multiple layers of liquid absorbent fabric located in said cover and extending the length of said body.

4. The disposable neck cushion of claim 3 including a section of foraminous, elastic, liquid absorbent and resilient material disposed between the layers of fabric.

5. The disposable neck cushion of claim 4 further including a liquid absorbing gel dispersed throughout said layers of fabric.

* * * * *